US005222051A

United States Patent [19]

Dubois et al.

[11] Patent Number: 5,222,051

[45] Date of Patent: Jun. 22, 1993

[54] ANALOGIC DISPLAY MODULE FOR A WATCH MOVEMENT

[75] Inventors: Gérald Dubois; François Berthoud, both of Le Lieu, Switzerland

[73] Assignee: Dubois & Depraz S.A., Le Lieu, Switzerland

[21] Appl. No.: 802,253

[22] Filed: Dec. 9, 1991

[30] Foreign Application Priority Data

Dec. 28, 1990 [CH] Switzerland ..... 4144/90

[51] Int. Cl.[5] ..... G04B 19/26

[52] U.S. Cl. ..... 368/19

[58] Field of Search ..... 368/19, 16

[56] References Cited

U.S. PATENT DOCUMENTS 4,623,259 11/1986 Oberst ..... 368/19
5,050,139 9/1991 Oberst ..... 368/19
5,086,416 2/1992 Dubois et al. ..... 368/19
5,114,345 5/1992 Vuarnesson ..... 368/19
5,115,417 5/1992 Saunders ..... 368/19

FOREIGN PATENT DOCUMENTS 87101165 12/1988 Fed. Rep. of Germany .
2500181 8/1982 France .
2645977 10/1990 France .

*Primary Examiner*—Bernard Roskoski
*Attorney, Agent, or Firm*—Young & Thompson

[57] ABSTRACT

The present invention relates to an analogic display module for a watch movement. This module comprises a dial (1) provided with a time graduation (2) and hands (3,4,5) to display the time. It comprises a display for the rhythm of the tides (50) presenting six juxtaposed zones 49 of different thicknesses cooperating with a hand (52) the axis of which is located on the line separating the two middle zones (49) and making one revolution in a time corresponding approximately to the time interval separating two sucessive high tides.

13 Claims, 3 Drawing Sheets

ANALOGIC DISPLAY MODULE FOR A WATCH MOVEMENT

BACKGROUND OF THE INVENTION

The present invention relates to an analogic display module for a watch movement comprising a dial provided with an hour graduation and hands for the display of the time, hours, minutes and eventually seconds. This module may comprise further a high and low tide display combined with the hours constituted by a circular graduation of twenty-four hours cooperating simultaneously on the one hand with a hand driven in rotation by a mechanism of the module at the rate of one turn each twenty-four hours, and on the other hand with a tide disk driven in rotation through a mechanism of the module. It can, according to variants, also comprise a display of the date and a moon phase display. This display module comprises driving mechanisms of the different displays which it presents actuated by a driver of a watch movement on which it is fixed. This driver can be constituted by the hours wheel, its axis, a pinion carried by this axis or any other movable member of the watch movement making one revolution within twelve hours. The watch movement provided with the present display module can be a mechanical movement, automatic or not, an electromechanical movement or a quartz movement.

Such a display module comprising an analogic indication of the tides is more particularly intended to equip watches for the sailors, sportsmen, fishermen, divers and in a general way intended for the sea people.

DESCRIPTION OF THE RELATED ART

A display module of this type has been described in the French patent Application No 2.645.977 published on Oct. 19, 1990. In such a display device the moon-phases and the high and low tides are driven each by an identical mechanism causing a movement of the member of these displays having a cycle of 29.5 days. This is of a sufficient precision for the display of the moon-phases which has principally an esthetic character instead of a utilitarian one, the error being of the order on 44 min and 2.8 second for each lunar cycle, which means about 9 hours and 23 minutes per year. However, this precision is insufficient for the display of the tides for sea professionals.

One of the aims of the present invention is the realization of a display module; the high and low tides display of which is sufficiently precise to be used by a professional of fishing or navigation. Another aim of the present invention is to realize a display module which indicates in an analogical way the raising and falling rhythm of the sea during each tide.

SUMMARY OF THE INVENTION

The analogical display device according to the present invention intended for a watch movement comprising a dial provided with a hour graduation and hands for the display of the time, including at least hours and minutes, is characterized by the fact that it comprises a display of the rhythm of the tides presenting six juxtaposed zones of different widths cooperating with one hand, the axis of which is located on the line separating the two middle zones, and making one revolution in a time corresponding approximately to the interval of time separating two successive high tides.

BRIEF DESCRIPTION OF THE DRAWINGS

The attached drawing shows schematically and by way of example one embodiment of the analogic display module according to the invention.

DETAILED DESCRIPTION OF THE INVENTION

Figure 1:
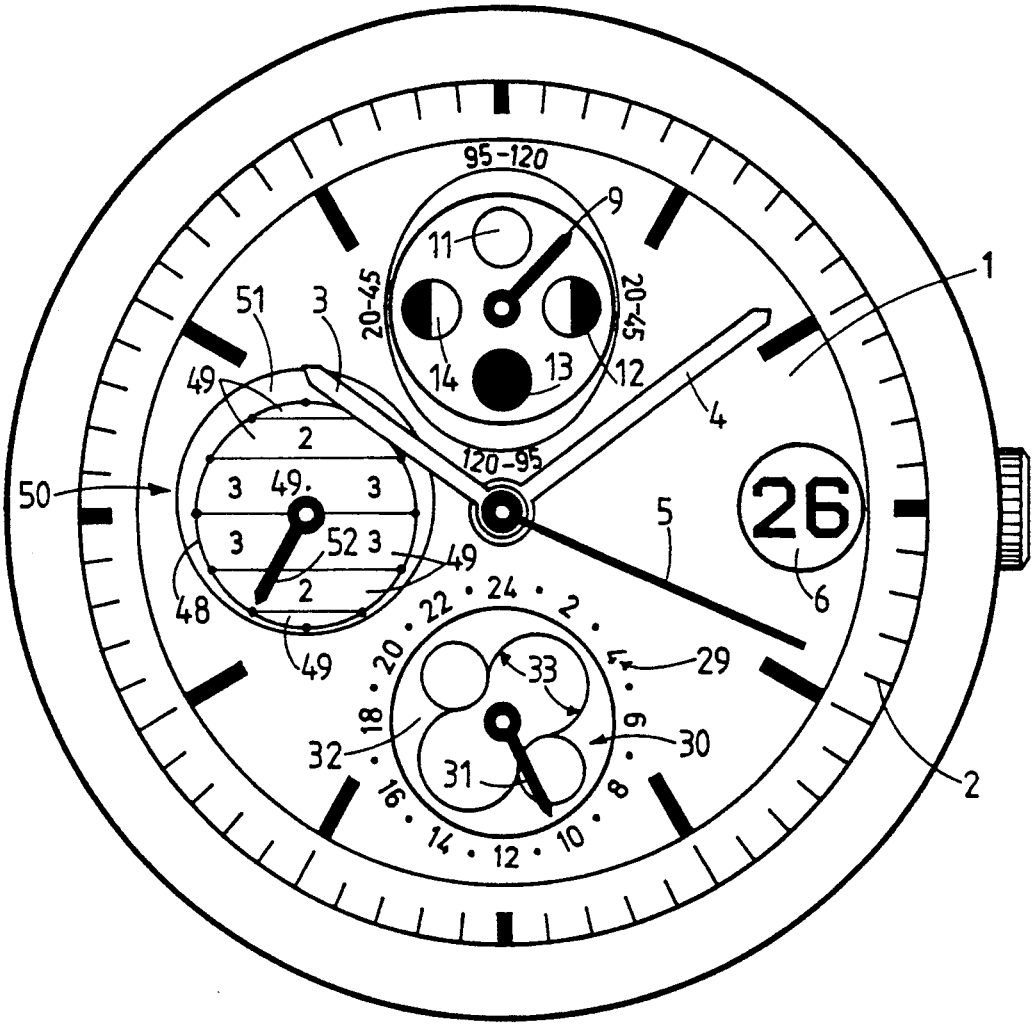
FIG. 1 is a top view of the display module.
Figure 2:
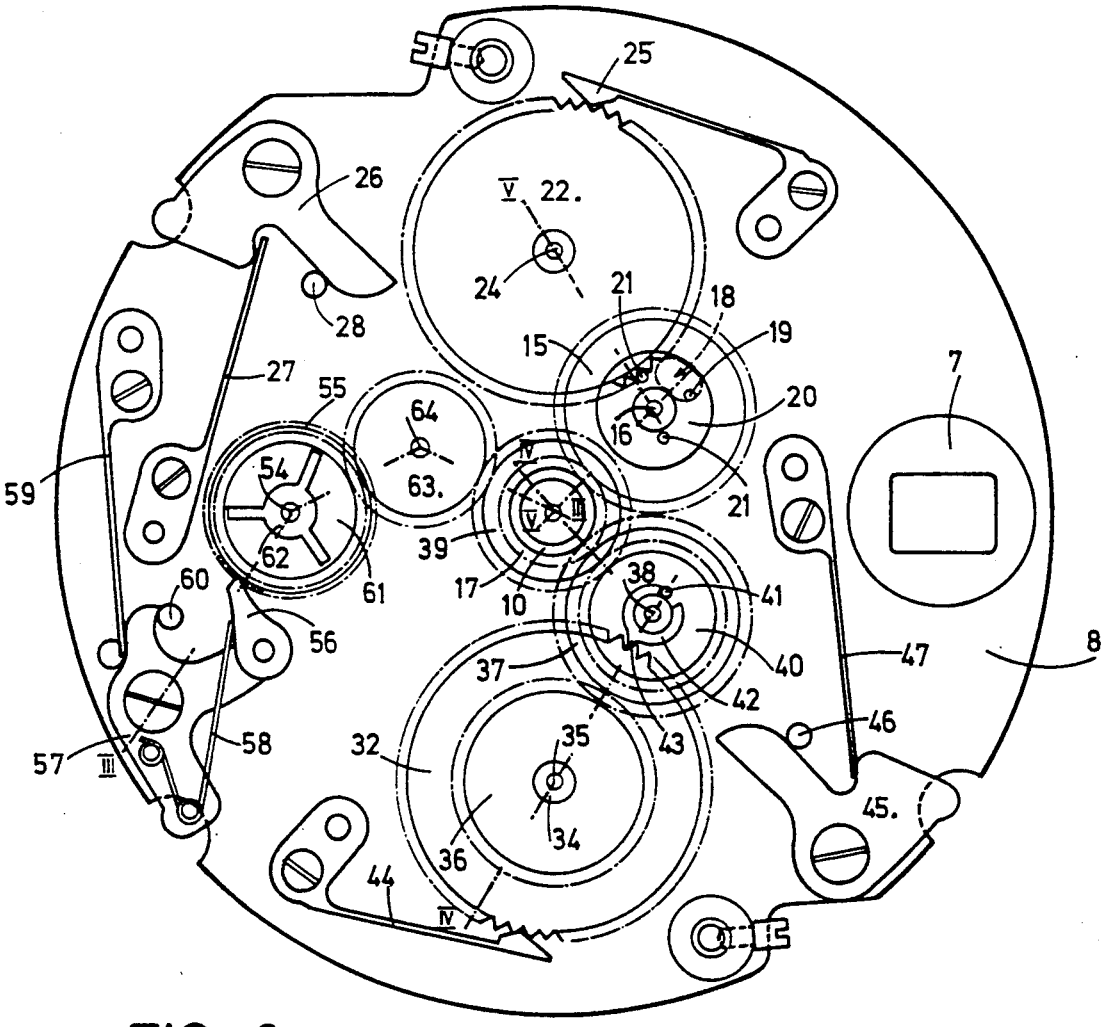
FIG. 2 is a top view of the mechanisms of the display module the dial being taken away.
Figure 3:
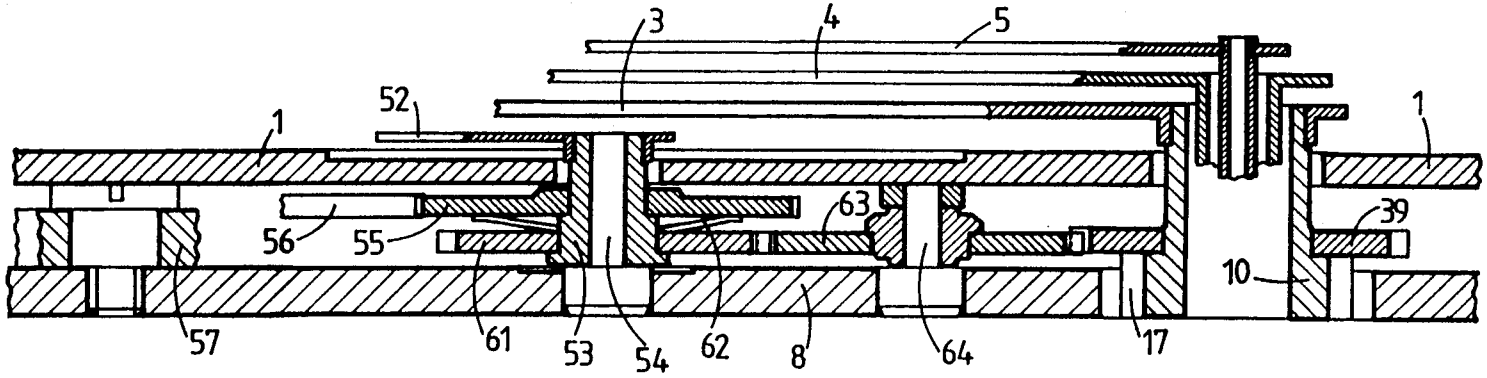
FIG. 3 is a cross-section along line III—III of FIG. 2 showing the mechanism for the display of the tide rhythm.
Figure 4:
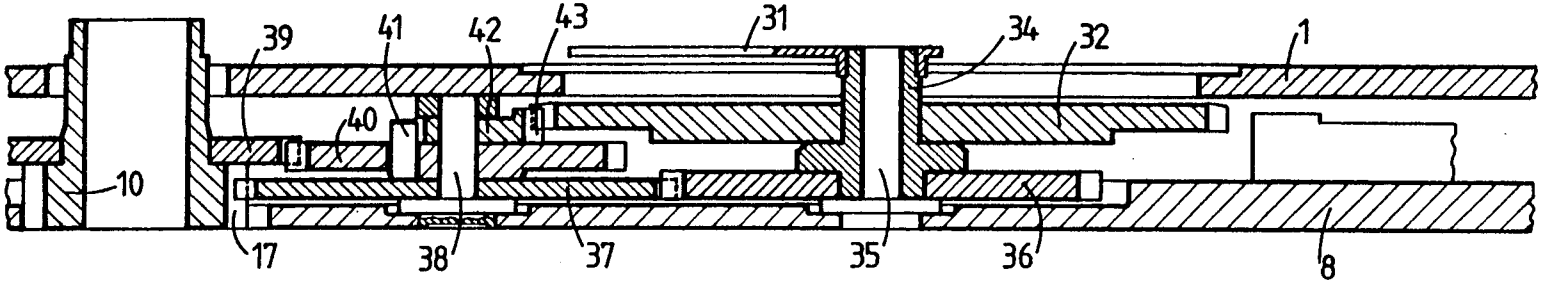
FIG. 4 is a cross-section along line IV—IV of FIG. 2 showing the mechanism of the high and low tides.
Figure 5:
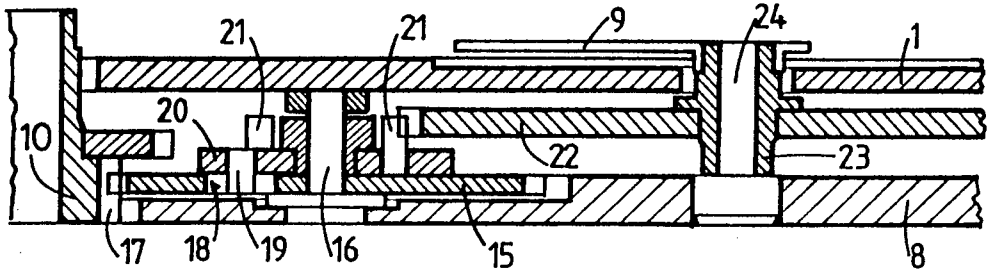
FIG. 5 is a cross-section along line V—V of FIG. 2 showing the mechanism for the moon phases.

In the embodiment shown the display module comprises a dial 1 provided at its periphery with a hour graduation 2 intended to cooperate with the hands for the hours 3, the minutes 4 and the seconds 5 of a conventional hand display of the watch movement on which the module is fastened.

The dial 1 is provided with an opening or window 6 located above an opening 7 provided in the base plate 8 of the module permitting thus to see a date indication carried by the date crown of the watch movement (not shown) on which the module is fixed.

The analogic display module comprises a display for the moon phases comprising a hand 9 driven at the rate of approximatively one turn per moon cycle through a moon phase mechanism by the sleeve 10 carrying the hour hand 3. The hand 9 cooperates with new moon 11, rising moon 12, full moon 13 and descending moon representations 14 carried by the dial around the axis of pivotment of this hand 9. In addition, the dial 1 carries numeric indications of the tide coefficient in front of these moon phases representations 11 to 14. The moon-phases mechanism comprises a wheel 15 pivoted on an axis 16 fixed in the base plate 8, in mesh with the pinion 17 fast with the sleeve 10. This wheel 15 makes one turn in twenty-four hours.

The wheel 15 comprises a slot 18 in which extends a pin 19 fast with a stud 20 idly pivoted on the shaft 16. This stud 20 carries two driving fingers 21 cooperating with the toothing having fifty-nine teeths of the moon wheel 22, the stud of which 23, pivoted on an axis 24 fast with the base plate, carries the hand 9. This mechanism is conventional and drives the hand 9 in one complete revolution in 29.5 days, which represents an error of 44 min 2.8 sec. for each synodic cycle and thus an error of about 9H23min per year. This is acceptable for a moon phase display, particularly if, as it is the case here, the moon wheel, indexed by a spring 25 fixed on the base plate 8, may be actuated by a correcting push member 26 pivoted on the base plate 8 and normally maintained in a rest position by a return spring 27 against an abutment 28.

This analogical display device comprises further a high and low tides display combined with a concentric hour indication. To this effect, the dial carries a circular graduation 29, disposed around a passage 30, of twenty-four hours cooperating with the hand 31 making one complete revolution in twenty-four hours. This display comprises further a tides disk 32, which can be seen through a passage 30 of the dial 1, and the upper surface of which presents a curve 33 forming two lobes which are opposed the one to the other as well as two inward extending curves indicating the high and low day ties respectively.

The hand 31 is carried by a sleeve 34 pivoted on an axis 35 fast with the base plate 8. The sleeve 34 is used as pivot for the tides disk 32. The sleeve 34 is fastened with a wheel 36 driven at the rate of one turn within twenty-four hours by the pinion 37 through the intermediary of a wheel 37 pivoted on an axis 38 fast with the base plate 8.

The driving in rotation of the tide disk 32 is made by a wheel 39 fast with the sleeve 10 making one turn in twelve hours and comprising fifty-seven teeths. This wheel 39 meshes with an intermediate wheel 40 comprising fifty-nine teeths pivoted on the axis 38. This intermediate wheel 40 comprises a finger 41 meshing with play with a stud 42 presenting a beak 43 acting on the toothing of fifty-seven teeths of the tides disk 32.

Thanks to this demultiplication the tides disk makes one turn in 12.421053 hours.

The theoretical time between two consecutive high tides according to the Brest Observatory is of 12h25min 14s, that is 12.420556 hours, that means an error of 0.000496 hour or 1.8 second for each cycle and thus a cumulative error for one year of $$\frac{365 \times 24}{12.420556} \times 1.8 = 21 \text{ min.}$$

15s this is insignificant even for the sea professionals.

The tides disk 32 is indexed by means of a spring 44 fixed to the base plate 8. This disk is submitted to the action of a correcting push member 45 pivoted on the base plate 8 and maintained in a rest position against an abutment 46 by means of a return spring 47.

One knows that the rising and descending rhythm of the level of the sea during each tide is regular. Whatever the value of the coefficient is, thus of the tide amplitude, it is possible to determine the height of the sea by using a mathematic method derived from the sinusoids. The correspondence is made by dividing by the value of the amplitude and in saying that the sea level increases or diminishes at rising or descending sea respectively by 1/12 the first hour, 2/12 the second hour, 3/12 during the third and fourth hours, 2/12 the fifth hour and again 1/12 at the sixth hour.

The present display module presents for the first time a display of the rhythm of the tides or of the variations of the water level during a tide by using this method of the twelfths which is well known from the sea people.

This tide rhythm display comprises on the dial 1 a circular graduation of twelve divisions 48 defining the horizontal bands or zones 49 of variable heights and of a value corresponding to one, two or three units.

Around the graduation 48 is a circle 50 which is upwardly excentered defining thus a zone 51 of variable thickness, which indicates if the tide is increasing, left part of the display, or decreasing, right part of the display. With the graduation 48 and thus the zones 49 cooperates a hand 52 making one complete revolution in 12.421053 hours, that is with a very small error of only 1.8 seconds for each tide, the theoretical time separating two high consecutive tides being 12.420556 hours as indicated above.

The hand 52 of this display of the rhythm of the tide is carried by a sleeve 53 pivoted on an axis 54 fast with the base plate 8. This sleeve 53 is fastened with a correcting wheel 55 comprising seventy-two teeths cooperating with a ratchet 56 pivoted on the free end of a correcting pusher 57 and applied against the toothing of this wheel 55 by means of hair spring 58. The correcting pusher 57 is pivoted on the base plate 8 and submitted to the action of a return spring 59 which maintains it in rest position against an abutment 60.

A wheel 61 is frictionally pivoted onto the sleeve 53 and is applied by means of a spring 62 against a shoulder of this sleeve 53 insuring a sufficient friction to drive in rotation the sleeve 53 by means of said wheel 61. The toothing of this wheel 61 comprises fifty-nine teeths and meshes with a toothing of fifty-seven teeths of the intermediate wheel 63 pivoted on an axis 64 fast with the base plate and meshing with the wheel 39 fast with the sleeve 10.

Thus, the hand 52 of the display of the rhythm of the tides cooperating with the zones 49 indicates to the user immediately where the level of the rising or falling tide is and this with a great precision, the same as the one obtained for the high and low tides display, that is 1.8s of error for a tide cycle.

This display of the rhythm of the tides enables the user to know at one sight the level of the water of the tide, the increasing or decreasing rhythm of this level of water, and thus the amplitude of the flow of the flux or reflux, as well as the precise state of the tide. These indications which are for the first time displayed on a watch are very useful for sea professionals and could be obtained until now only by means of a calculation.

The principle of this display of the rhythm of the tides is to place on a portion of the dial six juxtaposed zones of different thicknesses cooperating with a hand the axis of rotation of which is located on the line separating the two middle zones and which makes one complete revolution in a time equal or approximatively equal to the interval of time separating two successive high tides. This time interval is theoretically 12.420556 hours, and practically this hand makes one revolution in a time comprised preferably between 12.30 and 12.50.

We claim:

1. In an analogic display module for watch movement comprising a dial provided with an hour graduation and hands for the display of time, including at least the hour and minute, the improvement wherein the module further comprises a display of the rhythm of the tides presenting six juxtaposed zones including two middle zones, two intermediate zones, and two outside zones, said juxtaposed zones having different widths and cooperating with a corresponding hand which has an axis located on a line separating the two middle zones and makes one revolution in a time corresponding approximately to the interval of time separating two successive high tides.

2. Module according to claim 1, wherein the juxtaposed zones of the display of the rhythm of the tides are inscribed in a circle which is concentric to the corresponding hand.

3. Module according to claim 2, wherein the width of the middle zones are equal, the width of the two intermediate zones are equal, and the width of the two outside zones are equal.

4. Module according to claim 3, wherein the width of the middle zones is approximately equal to three times the width of the outside zones.

5. Module according to claim 4, wherein the width of the intermediate zones is approximately equal to twice the width of the outside zones.

6. Module according to claim 5, wherein the display of the rhythm of the tides further comprises on said dial a circular graduation of twelve divisions which define said juxtaposed zones.

7. Module according to claim 6, wherein the display of the rhythm of the tides further comprises a circumference around said circle, said circumference being excentered with respect to the circle in a direction which is perpendicular to lines separating the zones.

8. Module according to claim 1, further including a kinematical linkage for driving the corresponding hand of the display of the rhythm of the tides, said linkage comprising a wheel of 57 teeths and fast with a sleeve of the hour hand, an intermediate wheel of 57 teeths, and a wheel of 59 teeths, driving the corresponding hand.

9. Module according to claim 8, wherein the wheel of 59 teeths drives the sleeve of the hour hand by means of a friction coupling.

10. Module according to claim 8, wherein the sleeve of the hour hand is fast with a correcting wheel cooperating with a ratchet of a correcting pusher.

11. Module according to claim 1, further including a display of the high and low tides constituted by a circular graduation of twenty-four hours cooperating simultaneously with a hand driven into rotation by means of a mechanism of the module at a rate of one turn for twenty-four hours, and with a tides disk driven into rotation through a mechanism of the module at a rate of one turn for a time interval ranging between 12.3 and 12.5 hours.

12. Module according to claim 11, wherein the corresponding hand of the display of the rhythm of the tides makes one rotation within the same time interval as the tides disk.

13. Module according to claim 1, further including a display of the moon phases comprises representations of a new moon, a rising moon, a full moon and a descending moon on said dial, said representations cooperating with a hand making one completion revolution in 29.5 days.

* * * * *